US007232794B2

(12) United States Patent
Huyhn et al.

(10) Patent No.: US 7,232,794 B2
(45) Date of Patent: Jun. 19, 2007

(54) DISHWASHING WIPE

(75) Inventors: Vy Khanh Huyhn, Brussels (BE); Patrice Mark Luc Borgonjon, Mariakerke (BE); Denis Gerard O'Sullivan, Brussels (BE); JoAnna Margaret Clarke, Brussels (BE); Brian Jeffreys, Grimbergen (BE); Jeffrey Lee Butterbaugh, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 133 days.

(21) Appl. No.: 10/294,437

(22) Filed: Nov. 14, 2002

(65) Prior Publication Data

US 2003/0162684 A1 Aug. 28, 2003

Related U.S. Application Data

(63) Continuation-in-part of application No. PCT/US01/44453, filed on Nov. 27, 2001.

(30) Foreign Application Priority Data

Nov. 27, 2000 (EP) ..... 00870281

(51) Int. Cl.
*C11D 17/04* (2006.01)

(52) U.S. Cl. ..... 510/438; 510/439; 510/235; 510/237

(58) Field of Classification Search ..... 510/438, 510/439, 235, 237
See application file for complete search history.

(56) References Cited

U.S. PATENT DOCUMENTS

| | | | | |
|---|---|---|---|---|
| 3,116,574 | A | 1/1964 | Ciesielski et al. | 51/185 |
| 3,121,249 | A | 2/1964 | Affleck et al. | 15/506 |
| 3,169,264 | A | 2/1965 | Walker | 15/118 |
| 3,175,331 | A * | 3/1965 | Klein | 401/201 |
| 3,788,999 | A * | 1/1974 | Abler | 15/104.93 |
| 4,078,340 | A * | 3/1978 | Klecker et al. | 51/295 |
| 4,203,857 | A * | 5/1980 | Dugan | 15/104.93 |
| 4,987,632 | A * | 1/1991 | Rowe et al. | 15/104.93 |
| 4,991,362 | A * | 2/1991 | Heyer et al. | 451/532 |
| 5,213,588 | A | 5/1993 | Wong et al. | 51/293 |
| 5,429,545 | A | 7/1995 | Meyer | 451/523 |
| 5,507,968 | A * | 4/1996 | Palaikis | 15/229.11 |
| 5,573,710 | A * | 11/1996 | McDonell | 510/405 |
| 5,955,417 | A * | 9/1999 | Taylor | 510/438 |
| 6,013,349 | A | 1/2000 | Takeuchi et al. | 428/152 |
| 6,090,771 | A * | 7/2000 | Burt et al. | 510/384 |
| 6,267,975 | B1 * | 7/2001 | Smith et al. | 424/401 |
| 6,303,556 | B1 * | 10/2001 | Kott et al. | 510/357 |
| 6,340,663 | B1 | 1/2002 | Delco et al. | 510/438 |
| 6,342,473 | B1 * | 1/2002 | Kott et al. | 510/357 |
| 6,525,014 | B1 * | 2/2003 | Gorlin et al. | 510/439 |
| 6,528,476 | B1 * | 3/2003 | Bodet et al. | 510/476 |
| 6,624,133 | B1 * | 9/2003 | McKenzie et al. | 510/392 |
| 6,710,023 | B1 * | 3/2004 | Bodet et al. | 510/237 |
| 2002/0132747 | A1 | 9/2002 | Huyhn et al. | 510/218 |

FOREIGN PATENT DOCUMENTS

| | | |
|---|---|---|
| EP | 0 865 755 A1 | 9/1998 |
| GB | 1035475 | 7/1966 |
| JP | 02-200233 | 8/1990 |
| JP | 04-146257 | 5/1992 |
| JP | 05-001444 | 1/1993 |

* cited by examiner

*Primary Examiner*—Lorna M. Douyon
(74) *Attorney, Agent, or Firm*—Jeffrey V. Bamber; Laura R. Grunzinger

(57) ABSTRACT

A dishwashing wipe having a nonwaven hydroentangled polymer fiber topsbeet; a polymeric membrane; a nonwoven batting layer; and a polymeric scrim, with a dishwashing composition having an amine, a polymeric suds stabilizer, or enzymes incorporated in the wipe, wherein the dishwashing composition is in the form of stripes on the wipe.

8 Claims, 1 Drawing Sheet

DISHWASHING WIPE

REFERENCE TO RELATED APPLICATION

This application is a continuation-in-part of PCT patent application Ser. No. US01/44453 filed on Nov. 27, 2001, which is a continuation of EPO application Ser. No. 00870281.3 filed on Nov. 27, 2000.

TECHNICAL FIELD

The present invention relates to a process of cleaning dishware using a dishwashing wipe comprising a first softer, cleaning substrate and a second comparatively more abrasive scrubbing substrate comprising a web of fibres.

BACKGROUND

The habit of dishwashing by hand usually involves the use of two key components, namely a dishwashing composition and an applicator device. The applicator device is usually some sort of brush, cloth or sponge and is designed to be used over a period or weeks or months, owing to the cost. The habit of the user is thus to use the applicator to clean the dishware, rinse it after use and leave it on the side of the sink until the next time. However there is evidence to suggest that even after rinsing the applicator, food and other soil residues can remain on the applicator, providing a feeding ground for bacteria.

One method of combating this problem, as previously described in the prior art is a dishwashing composition comprising antibacterial agents. When using an antibacterial dishwashing composition, the user is encouraged to leave the applicator on the side of the sink still containing antibacterial detergent composition. The antibacterial agents thus disinfect the applicator in between uses. The Applicants have found an alternative solution to this problem by providing a disposable dishwashing wipe, which is intended for a limited number of uses only, for example one week, one day or one use. After use the consumer is instructed to discard the wipe. This solution has the additional benefit in that the user is no longer concerned, rightly or wrongly, with the presence of residues of antibacterial agents on dishware.

The Applicants have also found that consumers believe the task of dishwashing to be inconvenient since it requires a number of different applicators for example a cloth, scrubber, brush etc and a bottle of a dishwashing composition. In a preferred embodiment of the present invention the Applicants have also sought to address this problem by providing an all-in-one disposable dishwashing wipe which provides both an applicator, capable of cleaning and scrubbing even tough food soils/residues and sufficient dishwashing composition to get the job done.

In a preferred embodiment of the present invention the wipe comprises features which increase the general stiffness of the wipe. Traditional dishcloths are made from relatively flexible fabric making them useful for reaching into the corners of dishware, but are difficult to grip. On the other hand, a scourer or scrubbing sponge is comparatively less flexible and is consequently easier to grip, but is not sufficiently pliable to reach into the corners of dishware. Dishwashing wipes of the type discussed herein can tend to have flexibility of the same order as traditional dishcloths. It is therefore a further benefit of the present dishwashing wipes in that they can be manufactured so as to provide an appropriate level of stiffness in order to balance the needs for gripping the wipe and pliability to reach into corners.

In particular, it would be desirable to improve the stiffness of the wipe when wet. Traditional dishcloths tend to have relatively low stiffness both when dry and when wet. Dish care wipes can give relatively high stiffness when dry, but the stiffness tends to decrease significantly when the wipe is wet. The same applies to synthetic sponges, which exhibit very high dry stiffness, but significantly reduced wet stiffness. In a preferred aspect of the invention the wipe comprises features which increase the ratio of wet stiffness to dry stiffness.

SUMMARY OF THE INVENTION

According to the present invention there is provided a process of cleaning dishware using a disposable dishwashing wipe comprising a nonwoven or paper cleaning substrate and a comparatively more abrasive, scrubbing substrate comprising a web of fibres, the process comprising the steps of:

(a) contacting the dishwashing wipe and/or the dishware with water;

(b) subsequently contacting the dishware with the dishwashing wipe; and (c) optionally rinsing the dishware with water.

DETAILED DESCRIPTION OF THE INVENTION

The present invention relates to a process of cleaning dishware using a disposable dishwashing wipe. In the first step of the process, the dishware or dishwashing wipe, more preferably the dishwashing wipe, most preferably both the dishware and dishwashing wipe, are contacted with water. The dishware or dishwashing wipe may be contacted with water by allowing water to run freely over the surface, for example from a running tap, or the wipe and/or dishware may be contacted with water by placing the wipe or dishware in a sink, bowl or other suitable receptacle filled with water. In this latter embodiment the dishware may be allowed to soak for a period of time. This process may be recommended when extremely dirty dishware is to be cleaned.

In a preferred process of the present invention, after contacting the dishwashing wipe with water, either directly in water or by contact with wet dishware, the dishwashing wipe is squeezed so as to generate suds. The more the wipe is squeezed the more suds are generated. However it is not advisable to continue squeezing the wipe over an extended period of time, as the composition is wasted. In the second step of the process of the present invention, the dishware is contacted with the dishwashing wipe. Optionally, but preferably the dishware is rinsed with water before allowing to dry. Drying make take place passively by allowing for the natural evaporation of water or actively using any suitable drying equipment, for example a cloth or towel.

It is also envisaged that after washing the dishware, the user may use the dishwashing wipe to clean other hard surfaces for example the kitchen workbench, cooker, chopping board e.t.c. It is preferred that substantially all dishwashing composition, where present, is exhausted prior to using the dishwashing wipe to clean surfaces.

Dishwashing Wipe

The wipes used in the process of the present invention are disposable. By the term disposable it is meant that the wipe is designed to be used for a small number of dishwashing episodes only. In a preferred embodiment the wipe is used for one week, more preferably one day, i.e. 2-5 dishwashing episodes and then discarded, more preferably the wipe is designed to be used for one dishwashing episode only and then discarded. In the preferred embodiment wherein the wipe comprises a dishwashing composition, the term disposable is preferably defined as meaning that the wipe is used for as many dishwashing episodes as is possible before exhaustion of the dishwashing composition. The wipe is then preferably discarded.

Figure 1:
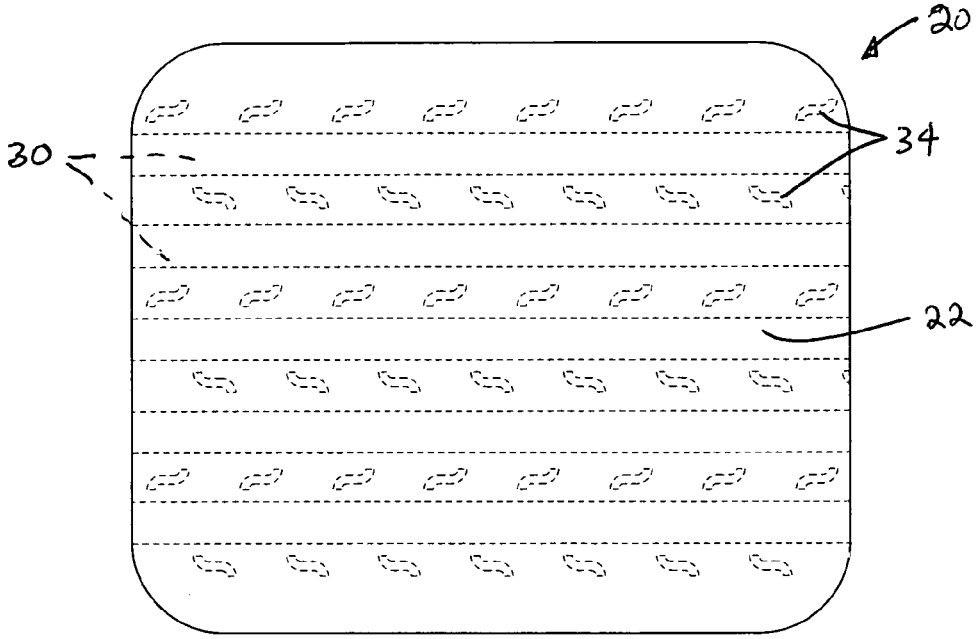
FIG. 1 is a top view of one embodiment of a dishwashing wipe.
Figure 2:
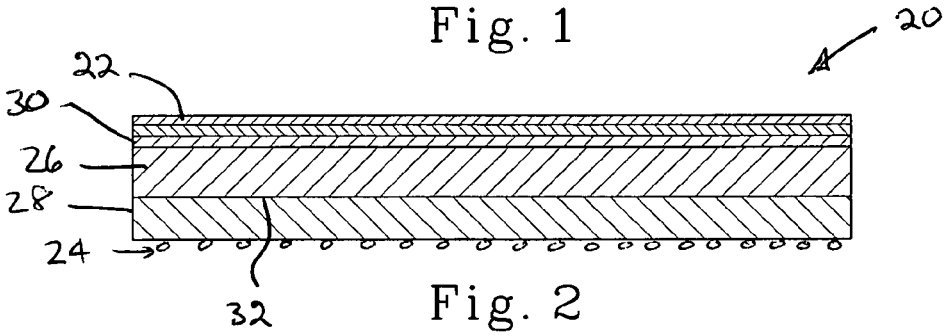
FIG. 2 is a schematic side view of the dishwashing wipe shown in FIG. 1.
Figure 3:
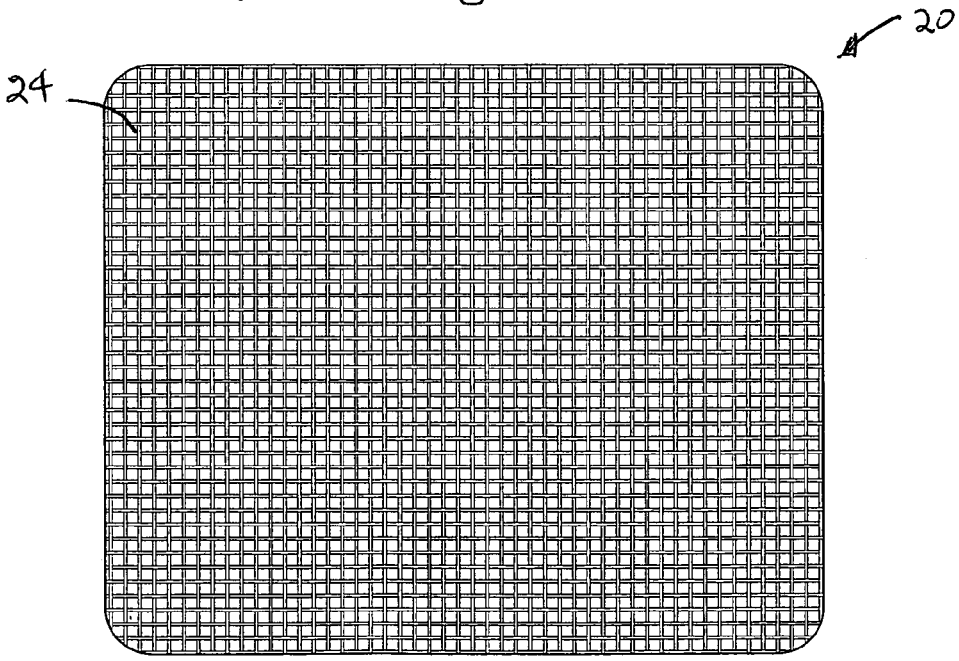
FIG. 3 is a bottom view of thedishwashing wipe shown in FIG. 1.

FIGS. 1-3 show one non-limiting embodiment of a dishwashing wipe 20. The wipe comprises as least two substrates, namely the cleaning and scrubbing substrate. In the embodiment shown in FIGS. 1-3, the wipe 20 comprises a first or top surface comprising a cleaning substrate 22, and a second or bottom surface comprising a scrubbing substrate 24. In FIGS. 1-3, the cleaning substrate 22 comprises a nonwoven fabric and the scrubbing substrate 24 comprises a scrim. The wipe 20 further comprises two layers of batting, 26 and 28, and a dishwashing composition in the form of several (e.g., five) strips of paste 30 between the cleaning substrate 22 and the layers of batting 26 and 28. The component parts of the wipe 20 are held together by adhesive 32 between the layers of batting 26 and 28, and by bonds 34. The cleaning substrate provides a softer surface when compared with the comparatively more abrasive scrubbing substrate. The comparison can be performed using machinery specifically built for the purpose, but is in this invention determined by touch. A panel of ten substrate experts are given both the cleaning substrate and the scrubbing substrate and are asked to identify by touch, which is the more abrasive substrate. The experts hold the substrate between thumb and fingers with both hands, then rub the surface of the wipe with the thumb nail of the right hand whilst maintaining the position of the left thumb and fingers of both hands. The scrubbing substrate is thus defined as the substrate which the majority of the experts have identified as being the more abrasive.

The Cleaning Substrate

The cleaning substrate of the present invention is composed of nonwoven fibres or paper. The term nonwoven is to be defined according to the commonly known definition provided by the "Nonwoven Fabrics Handbook" published by the Association of the Nonwoven Fabric Industry. A paper substrate is defined by EDANA (note 1 of ISO 9092-EN 29092) as a substrate comprising more than 50% by mass of its fibrous content is made up of fibres (excluding chemically digested vegetable fibres) with a length to diameter ratio of greater than 300, and more preferably also has density of less than 0.040 g/cm$^3$. To be clear, the definitions of both nonwoven and paper substrates do not include woven fabric or cloth or sponge. The cleaning substrate is preferably partially or fully permeable to water and the dishwashing composition, where present. The substrate is preferably flexible and even more preferably the substrate is also resilient, meaning that once applied external pressure has been removed the substrate regains its original shape.

The cleaning substrate may comprise natural or synthetic fibres. Natural fibres include all those which are naturally available without being modified, regenerated or produced by man and are generated from plants, animals, insects or by-products of plants, animals and insects. Preferred examples of natural fibres include cellulosic fibres, including wood pulp, cotton, hemp, jute, fax and combinations thereof. Natural material nonwovens useful in the present invention may be obtained from a wide variety of commercial sources. Nonlimiting examples of suitable commercially available paper useful herein include Airtex®, an embossed airlaid cellulosic having a base weight of about 71 gsy, available from James River, Green Bay, Wis.; and Walkisoft®, an embossed airlaid cellulosic having a base weight of about 75 gsy, available from Walkisoft U.S.A., Mount Holly, N.C.

As used herein, "synthetic" means that the materials are obtained primarily from various man-made materials or from natural materials that have been further altered. Nonlimiting examples of synthetic materials useful in the present invention include those selected from the group consisting of acetate fibers, acrylic fibers, cellulose ester fibers, modacrylic fibers, polyamide fibers, polyester fibers, polyolefin fibers, polyvinyl alcohol fibers, rayon fibers and combinations thereof. Examples of suitable synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephalate fiber, dacron; polyolefins such as polypropylene, polyethylene; polyvinyl acetate fibers and combinations thereof. These and other suitable fibers and the nonwovens prepared therefrom are generally described in Riedel, "Nonwoven Bonding Methods and Materials," *Nonwoven World* (1987); *The Encyclopedia Americana*, vol. 11, pp. 147-153, and vol. 26, pp. 566-581 (1984).

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining substrate. In the present invention the nonwoven substrate can be prepared by a variety of processes including, but not limited to, air-entanglement, hydroentanglement, thermal bonding, and combinations of these processes.

Nonwovens made from synthetic materials useful in the present invention can be obtained from a wide variety of commercial sources. Nonlimiting examples of suitable nonwoven materials useful herein include HEF 40-047, an apertured hydroentangled material containing about 50% rayon and 50% polyester, and having a basis weight of about 61 grams per square meter (gsm), available from Veratec, Inc., Walpole, Mass.; HEF 140-102, an apertured hydroentangled material containing about 50% rayon and 50% polyester, and having a basis weight of about 67 gsm, available from Veratec, Inc., Walpole, Mass.; Novonet® 149-616, a thermo-bonded grid patterned material containing about 100% polypropylene, and having a basis weight of about 60 gsm available from Veratec, Inc., Walpole, Mass.; Novonet® 149-801, a thermo-bonded grid patterned material containing about 69% rayon, about 25% polypropylene, and about 6% cotton, and having a basis weight of about 90 gsm, available from Veratec, Inc. Walpole, Mass.; Novonet® 149-191, a thermo-bonded grid patterned material containing about 69% rayon, about 25% polypropylene, and about 6% cotton, and having a basis weight of about 120 gsm, available from Veratec, Inc. Walpole, Mass.; HEF Nubtex® 149-801, a nubbed, apertured hydroentangled material, containing about 100% polyester, and having a basis weight of about 84 gsm, available from Veratec, Inc. Walpole, Mass.; Keybak® 951V, a dry formed apertured material, containing about 75% rayon, about 25% acrylic fibers, and having a basis weight of about 51 gsm, available from Chicopee, New Brunswick, N.J.; Keybak® 1368, an apertured material, containing about 75% rayon, about 25% polyester, and having a basis weight of about 47 gsm, available from Chicopee, New Brunswick, N.J.; Duralace® 1236, an apertured, hydroentangled material, containing about 100% rayon, and having a basis weight from about 48 gsm to about 138 gsm, available from Chicopee, New Brunswick, N.J.; Duralace® 5904, an apertured, hydroentangled material, containing about 100% polyester, and having a basis weight from about 48 gsm to about 138 gsm, available from Chicopee, New Brunswick, N.J.; Chicopee® 5763, a carded hydroapertured material (8×2 apertures per inch, 3×2 apertures per cm), containing about 70% rayon, about 30% polyester, and a optionally a latex binder (Acrylate or EVA based) of up to about 5% w/w, and having a basis weight from about 60 gsm to about 90 gsm, available form Chicopee, New Brunswick, N.J.; Chicopee® 9900 series (e.g., Chicopee 9931, 62 gsm, 50/50 rayon/polyester, and Chicopee 9950 50 gsm, 50/50 rayon/polyester), a carded, hydroentangled material, containing a fiber composition of from 50% rayon/50% polyester to 0% rayon/100% polyester or 100% rayon/0% polyester, and having a basis weight of from about 36 gsm to about 84 gsm, available form Chicopee, New Brunswick, N.J.; Sontara 8868, a hydroentangled material, containing about 50% cellulose and about 50% polyester, and having a basis weight of about 72 gsm, available from Dupont Chemical Corp. Preferred non-woven substrate materials have a basis weight of about from 24 gsm to about 200 gsm, more preferably from about 36 gsm to about 110 gsm, and most preferably from about 42 gsm to about 78 gsm.

In addition to the fibres used to make the substrate, the substrate can comprise other components or materials added thereto as known in the art, including binders as specified. The term "binder" as used herein describes any agent employed to interlock fibers. Such agents comprise wet strength resins and dry strength resins. It is often desirable particularly for cellulose based materials to add chemical substances known in the art as wet strength resins. A general dissertation on the types of wet strength resins utilised namely in the paper art can be found in TAPPI monograph series No. 29, Wet Strength in Paper and Paperboard, Technical Association of the Pulp and Paper Industry (New York, 1965). In addition to wet strength additives, it can also be desirable to include certain dry strength and lint control additives known in the art such as starch binders. Preferred binders used to bond non-wovens are polymeric binders, preferably latex binders, more preferably waterborne latex binders. Suitable binders include butadiene-styrene emulsions, ethylene vinyl acetate emulsions, vinyl acetate, vinyl chloride and combinations thereof. Preferred latex binders are made from styrene, butadiene, acrylonitrile-butadiene emulsions or combination thereof. Other preferred binders include non-acrylate binders. The term non-acrylate binder, as used herein, encompasses all latex binders that do not comprise acrylic acid or acrylic acid ester or vinyl acetate monomers. Preferred binders according to the present invention include: Butadiene-styrene emulsions, carboxylated styrene-butadiene emulsion, Acrylonitrile-butadiene emulsions, polyacrylamide resins, Polyamide-epichlorohydrin resin, Acrylonitrile-Butadiene-Styrene emulsion, Styrene Acrylonitrile.

The binder can be applied to the substrate by any method known in the art. Suitable methods include spraying, printing (e.g. flexographic printing), coating (e.g. gravure coating or flood coating), padding, foaming, impregnation, saturation and further extrusion whereby the binder is forced through tubes in contact with the substrate whilst the substrate passes across the tube or combinations of these application techniques. For example spraying the binder on a rotating surface such as calendar roll that then transfers the binder to the surface of the substrate. The most preferred method for the application of the binder is spraying onto the substrate. Most preferably the binder is sprayed onto one side of the substrate in one step of application and onto the other side of the substrate in an independent step of application.

In a particularly preferred embodiment the cleaning substrate is made from a lofty substrate, more preferably a batting substrate. Batting is defined according to the TAPPI Association of the Nonwoven Fabrics Industry as a soft bulky assembly of fibres. Batting preferably comprises synthetic materials. Suitable synthetic materials include, but are not limited to, acetate fibers, acrylic fibers, cellulose ester fibers, modacrylic fibers, polyamide fibers, polyester fibers, polyolefin fibers, polyvinyl alcohol fibers, rayon fibers, and combinations thereof. Preferred synthetic materials, particularly fibers, may be selected from the group consisting of nylon fibers, rayon fibers, polyolefin fibers, polyester fibers, and combinations thereof. Preferred polyolefin fibers are fibers selected from the group consisting of polyethylene, polypropylene, polybutylene, polypentene, and combinations and copolymers thereof. More preferred polyolefin fibers are fibers selected from the group consisting of polyethylene, polypropylene, and combinations and copolymers thereof. Preferred polyester fibers are fibers selected from the group consisting of polyethylene terephthalate, polybutylene terephthalate, polycyclohexylenedimethylene terephthalate, and combinations and copolymers thereof. More preferred polyester fibers are fibers selected from the group consisting of polyethylene terephthalate, polybutylene terephthalate, and combinations and copolymers thereof. Most preferred synthetic fibers comprise solid staple polyester fibers that comprise polyethylene terephthalate homopolymers. Suitable synthetic materials may include solid single component (i.e., chemically homogeneous) fibers, multiconstituent fibers (i.e., more than one type of material making up each fiber), and multicomponent fibers (i.e., synthetic fibers which comprise two or more distinct filament types which are somehow intertwined to produce a larger fiber), and combinations thereof. Such bicomponent fibers may have a core-sheath configuration or a side-by-side configuration. In either instance, the batting may comprise either a combination of fibers comprising the above-listed materials or fibers which themselves comprise a combination of the above-listed materials. In any instance, side-by side configuration, core-sheath configuration, or solid single component configuration, the fibers of the batting may exhibit a helical or spiral or crimped configuration, particularly the bicomponent type fibers.

In a preferred embodiment a proportion of the fibers are susceptible of heat sealing. In a particularly preferred embodiment the cleaning substrate comprises a combination of single component and bicomponent fibres. More specifically it is preferred that the cleaning substrate comprises polyester single component fibres and polyester core, polyethylene sheath bicomponent fibres.

The batting may also comprise natural fibers. Suitable natural fibers are described above.

Furthermore, the fibers of the batting may be of varying sizes, i.e., the fibers of the batting may comprise fibers having different average thicknesses. Also, the cross section of the fibers can be round, flat, oval, elliptical or otherwise shaped.

One preferred type of nonwoven fibre cleaning substrate is formed from synthetic fibre materials. Preferably the fibres comprise polypropylene fibres or viscose fibres or, more preferably, a blend of polypropylene and viscose fibres. Such nonwoven materials are preferably made by a process of hydroentanglement.

In a preferred embodiment the wipe comprises at least two different cleaning substrates, meaning that the composition of each cleaning substrate differs from the other. Preferably the different cleaning substrates are selected for their disposability, absorbency and suds generating characteristics. The Applicants have found that whereas paper substrates are generally the most biodegradable and thus the preferred substrate material for perceived disposability, they are not preferred for absorbency and suds generation. By contrast nonwoven substrates, especially batting substrates have excellent suds generation abilities, but are less biodegradable and thus perceived to be less disposable than paper substrates. It is thus preferred to employ different cleaning substrates, so as to produce a wipe which exhibits all characteristics. In one preferred aspect the wipe comprises two cleaning substrates, a paper substrate and a nonwoven substrate, preferably a lofty, more preferably a batting substrate.

In a further preferred aspect the wipe comprises at least one batting substrate and at least one additional nonwoven substrate, preferably a hydroentangled web formed from a blend of synthetic fibres, preferably polypropylene and viscose.

Particularly preferred wipes comprise at least three cleaning substrates, comprising two batting substrates and a hydroentangled nonwoven web substrate.

In a preferred embodiment at least one cleaning substrate comprises a water-swellable material, that is a material which swells on contact with water. In a particularly preferred embodiment at least one cleaning substrate is a batting layer which comprises swellable material. Suitable swellable materials include cellulosic fibers, sponges, and super-absorbent polymer. Super-absorbent polymer materials can be present, for instance in the form of particles or fibers. If cellulosic materials are used these can be, for instance, in the form of paper or fibrous pulp, in particular air-laid pulp. Air-laid pulp can comprise for instance paper pulp and/or bicomponent fibers. If fibrous materials such as air-laid pulp are used then preferably this comprises at least one material which functions to improve the integrity of a layer. Bicomponent fibers such as polyethylene/polyethylene terephthalate or polyethylene/polypropylene fibers which fuse on heating can have this effect, as can soaking the layer in latex paint.

In this embodiment the cleaning substrate may consist essentially of a swellable material but preferably the amount of swellable material is from 10 to 90 wt %, preferably 20 to 80 wt %, based on the weight of the substrate.

The Scrubbing Substrate

As defined above, the scrubbing substrate provides a comparatively more abrasive surface than the cleaning substrate and as such is useful in scrubbing food residue/soil, especially tough to remove residue/soil, from dishware. The Scrubbing substrate comprises an abrasive web of fibres. By the term 'web' it is meant a structure made directly from melts or fibres which are at least 0.2 mm long and are held together by systems other than hydrogen bonding. The fibres may be selected from metal, natural or synthetic wires, filaments or strands or mixtures thereof as long as the resulting web provides a surface which is more abrasive than the cleaning substrate. Preferred fibres are selected from those of synthetic organic origin, more preferably from polymeric synthetic organic origin and thermoplastic polymers. The fibres are preferably selected from polyamide, polyethylene, polypropylene fibres and mixtures thereof.

The fibres may be randomly arranged, but are preferably ordered. The web may be made using any known process, including those described above for preparing nonwoven substrates. In a preferred embodiment the fibres are arranged in an open web lattice wherein the fibres are, for example, knitted or extruded together to form the web. In a particularly preferred embodiment of the present invention the scrubbing substrate comprises a polymeric mesh, scrim or combinations thereof. In an alternative embodiment the web may be macroscopically expanded. By the term "macroscopically expanded, we mean webs which have been caused to conform to the surface of a three-dimensional forming structure so that both surfaces thereof exhibit a three-dimensional forming pattern of surface aberrations corresponding to the macroscopic cross-section of the forming structure, wherein the surface aberrations comprising the pattern are individually discernible to the normal naked eye (i.e., normal naked eye having 20/20 vision) when the perpendicular distance between the viewer's eye and the plane of the web is about 12 inches. For example the web may be embossed, meaning that the web exhibits a pattern comprised primarily of male projections. On the other hand, the web may be debossed, meaning that the web exhibits a pattern comprised primarily of female capillary networks. As with the cleaning substrate it is highly preferred that the scrubbing substrate is flexible and even more preferably the substrate is also resilient meaning that once applied pressure has been removed the substrate regains its original shape.

The dishwashing wipe may comprise two or more scrubbing substrates. As discussed above, the wipe may also comprise more than one cleaning substrate. It therefore comes about that the substrates can be arranged in a number of different ways. Where the wipe comprises only one cleaning and one scrubbing substrate the substrates are preferably packed in a layered fashion, back to back. Where the wipe comprises two or more cleaning substrates it is preferred that the cleaning substrates are packed in a layered fashion, back to back, and at least one scrubbing surface is then attached to one side of one of the cleaning substrates. Where the wipe comprises two or more scrubbing substrates, said substrates may be packed side by side such that both scrubbing substrates are in contact with the cleaning substrate. Alternatively and most preferably where the wipe comprises two or more scrubbing substrates the substrates are arranged one on top of the other in a layered fashion, one of the scrubbing substrates being in contact with the cleaning substrate. Where the scrubbing substrate is prepared by embossing or debossing, it is preferred that the most abrasive side(s) faces away from the cleaning substrates, so as to present the most abrasive surfaces for dishwashing. Where more than one scrubbing substrate is used, it is preferred that the scrubbing substrates are attached to one another, such that at least a portion, preferably the majority of the scrubbing substrates, can move independently of the other.

Choice of the properties of a scrim can influence stiffness of the wipes. For instance, the number of strands per centimeter can influence stiffness. A range of 1.5 to 3.5 strands per centimeter, preferably 2.3 strands per centimeter, has been found to be beneficial for strands extending in the machine direction. A range of from 2 to 4 strands per centimeter, preferably 2.2 to 3.4 strands per centimeter, is beneficial for strands extending in the transverse direction.

The thickness of the strands, as measured by the basis weight, also influences stiffness. Basis weight in the range 25 to 55 g/m$^2$ is preferred, in particular in the range 30 to 50 g/m$^2$. When the number of strands per centimeter is relatively low, for instance in the range of below 2.3 strands per centimeter machine direction and/or below 2.8 strands per centimeter transverse direction, basis weight is preferably at least 40 g/m$^2$. When the number of strands per centimeter is relatively high, in particular at least 2.4 strands per centimeter machine direction and/or at least 3 strands per centimeter transverse direction, basis weight is preferably not more than 38 g/m$^2$.

The configuration of the strands of the scrim can be chosen so as to improve stiffness. For instance, strands arranged as two parallel series substantially at right angles, i.e. a square or rectangular grid, can give improved stiffness over other arrangements.

If a scrim is used, a single layer may be applied but additional layers can give increased stiffness.

The cleaning and scrubbing substrates are preferably attached, potentially reversibly attached, to one another. The point of attachment can be at any point over the surface of the wipe, as long as the scrubbing substrate(s) and cleaning substrate(s) are attached to one another. Even more preferably the cleaning and scrubbing substrates are attached to one another around the perimeter of the scrubbing and/or cleaning substrates. The substrates may be attached to one another using any commonly known method, for example using heat sealing, adhesive, ultrasonic sealing, stitching and combinations thereof. Preferably the substrates are attached to one another using heat sealing. Even more preferably the substrates are attached to one another, by a combination of heat sealing around the perimeter of the substrate and dot heat sealing, preferably in a pattern, across the surface area of the wipe. This latter method of heat sealing is described in more detail in the embodiment comprising a partially or fully water impermeable membrane. Where heat sealing is used, it is necessary that the cleaning and/or scrubbing substrate comprise thermoplastic polymers.

The bonding pattern can be chosen in order to maximize stiffness of the wipe. This applies in particular when bonding is effected by adhesive (chemical, such as epoxy resin adhesive, or other adhesive) or by ultrasound. Thermal or pressure bonding can be used if the layers to be bonded are appropriate for this. One preferred bonding pattern is application of adhesive or ultrasonic bonding across the full area of the substrates to be bonded. Generally such patterns do not take up substantially the entire area, but generally not more than 20%, preferably not more than 15%, but preferably at least 5%, of the area of the substrate is covered by bonds.

One preferred application pattern for adhesive, ultrasonic or other bonds is in the form of a number of stripes extending across the width of the substrate. Preferably the stripes are parallel. The direction can be chosen depending upon the direction in which stiffness is required. For instance, if stiffness in the machine direction (this direction being defined in relation to the manufacturing process for the substrate) is required, i.e. it is required to make folding along a line extending in the transverse direction more difficult, then the stripes preferably extend in the machine direction. Conversely, if transverse direction stiffness is required, then preferably stripes extending in the transverse direction are provided.

A particularly preferred bonding pattern is one of two sets of parallel stripes at different angles, for instance in cross-hatch form. Such systems can provide the effect of introduction of a net between two layers.

The above patterns for improvement of stiffness are useful when applied to adhesive or ultrasound bonding. However, such patterns can alternatively be applied using hot melt polymer printed onto the wipe, either between substrates or on an exterior surface of one of the substrates. Such patterns can be applied using any low melting polymer which is flexible after application and drying and capable of producing a continuous film. Suitable polymers include polyethylene. Application of hot melt polymer can be for instance by screen or gravure printing. Screen printing is preferred.

Application of hot melt polymer is preferably on an exterior surface on one of the layers.

Bonding can be effected after all substrate layers intended to form the wipe have been assembled. In some embodiments, however, two or more layers can be pre-bonded prior to contacting these layers with additional layers to form the wipe.

It is also possible to enhance stiffness of the wipe by means of embossing predetermined patterns onto one or more substrates. The patterns are advantageously those discussed above in the context of bonding patterns. Embossing can be achieved by application of the desired pattern under pressure at high or low temperature. Alternatively ultrasound methods can be used for embossing.

If any substrate layer is to be embossed it is preferably subjected to embossing prior to contact with other layers intended to form the wipe.

Dishwashing Composition

The dishwashing wipes of the present invention, preferably have incorporated therein a dishwashing composition. The composition may be applied to the exterior surface of one of the substrates or alternatively may be applied in between the substrates, to an inside surface of one of the substrates or during manufacture of the substrates, for example by soaking the fibres in dishwashing composition.

The composition can be applied to the substrate during or after manufacture of the wipe. The composition can be applied using any application method known in the art. Suitable methods include spraying, printing, (e.g. flexographic printing), coating (e.g. gravure coating or flood coating), soaking the fibres of the substrates, extrusion whereby the composition is forced through tubes in contact with the substrate whilst the substrate passes across the tube or combinations of these application techniques. For example spraying the composition on a rotating surface such as calender roll that then transfers the composition to the surface of the substrate. The composition can be applied either to one surface of the substrate or both surfaces, preferably both surfaces. The preferred application method is extrusion coating.

The composition can also be applied uniformly or non uniformly to the surfaces of the substrate. By non uniform it is meant that for example the amount and pattern of distribution of the composition can vary over the surface of the substrate. For example some of the surface of the substrate can have greater or lesser amounts of composition, including portions of the surface that do not have any composition on it. Preferably however the composition is uniformly applied to the surfaces of the wipes.

Preferably, the composition can be applied to the substrate at any point after it has been dried. For example the composition can be applied to the substrate preferably after calendering and prior to being wound up onto a parent roll. Typically, the application will be carried out on a substrate unwound from a roll having a width equal to a substantial number of wipes it is intended to produce. The substrate with the composition applied thereto is then subsequently perforated utilising standard techniques in order to produce the desired perforation line.

The composition may be in any suitable form, for example tablet, block, particulate, liquid, friable or water-soluble capsules or encapsulates, gel or paste form or combinations thereof. In a preferred aspect the composition is in the form of a paste having viscosity (measured at shear rate of 0.6 for 10 s at 20° C. using a Bohlin Viscometer with a 4 cm diameter stainless steel plate) of greater than 20 000 cps.

Depending on the form of the composition, the wipe may be substantially dry or wet to the touch. Preferably the wipe is substantially dry to the touch meaning that when the following moisture test is applied the wipe falls within 4 and 5 on the scale. A dry sheet of disposable Bounty (tradename) Kitchen Towel is placed over the wipe such that the entire wipe is covered by one layer of Bounty Kitchen Towel. A 3 cm by 3 cm 50 gram weight is placed on top on the wipe and Bounty sheet. The weight is left for 1 minute and then removed. The amount of moisture transferred from the wipe to the sheet of Bounty during the above test method is a measure of the wetness of the wipe. The bounty sheet is visually graded according to the below scale for the presence of a moisture mark, perceived as a visual difference in appearance of the Bounty sheet when held up to a light source. The scale is based on the percentage coverage of a moisture mark over the 3 cm by 3 cm area of the Bounty sheet which was covered by the weight (weight area).

| Scale | % coverage of the weight area |
|---|---|
| 1 | greater than 80% |
| 2 | 75-80% |
| 3 | 40-75% |
| 4 | less than 10% |
| 5 | less than 5% |

The amount of dishwashing composition applied to the dishwashing wipe is determined by the type of dishwashing job intended. Thus if the wipe is designed for cleaning a small number of dishes, the amount of composition required would be less than if the wipes were designed for cleaning a large number of dishes or heavily soiled dishes.

The composition may comprise a variety of ingredients for example amine, surfactants, solvents, polymeric suds stabiliser, enzymes, salts, builder, perfume, chelating agent and mixtures thereof. All parts, percentages and ratios used herein are expressed as percent weight unless otherwise specified. All documents cited are, in relevant part, incorporated herein by reference.

Where a dishwashing composition is present in the wipe according to the present invention, it may also be preferable to include a method of controlling the release of the composition from the wipe. This is especially necessary if the wipe is designed to be used for greater than one dishwashing episode. One means of controlling the release of composition is to use a composition in thickened form for example a gel, paste, particulate or solid form. Compositions in this form preferably comprise a thickening agent, most preferably Hydroxy Propyl Methyl Cellulose (HPMC). Alternatively, controlled release of the dishwashing composition may be achieved by using different forms of the composition. For example a composition in liquid form will provide immediate dishwashing composition as the liquid is easily leached from the wipe. Comparatively, a solid composition will require a longer period of time to dissolve in water and then be leached from the wipe. Hence in a preferred aspect the dishwashing wipe of the present invention comprises a dishwashing composition in both solid, preferably particulate form and liquid, gel but preferably paste form. Another means of controlling release is by using water-soluble or friable capsules or encapsulates, for example water-soluble gel capsules comprising a dishwashing composition in solid, particulate, liquid, gel or paste form.

Alternatively the wipe may be constructed such that dishwashing composition is sandwiched between two substrates, more preferably two cleaning substrates. More preferably the composition is sandwiched between at least one cleaning substrate and at least one partially or fully water impermeable membrane. Most preferably the composition is sandwiched between two partially or fully water impermeable membranes, which is then sandwiched by two substrate, more preferably at least one cleaning substrate and most preferably two cleaning substrates. The membrane may preferably consist of a generally water impermeable membrane comprising perforations large enough to allow permeability of water and/or may dissolve with time on contact with water. Alternatively the membrane may be provided by applying a fully or partially water impermeable substance to one side of a cleaning substrate, producing a laminated substrate. The laminated side of the substrate would then preferably be arranged such that it was in closest proximity to the dishwashing composition. In order to avoid the membranes gliding over one another, the membranes and cleaning substrates are preferably dot heat sealed at preferably even intervals across the surface of the cleaning substrates.

Further still, the method of controlling release of the composition from the wipe may be to contain the composition within substantially sealed compartments. By substantially sealed it is meant that the compartments are sealed with the exception of a few perforations which allow the escape of the composition at a considerably slowed rate.

Inclusion of a partially or fully water impermeable membrane layer can increase the stiffness of the wipe. Preferred film materials for this purpose are polyethylene, in particular low molecular weight polyethylene. Ethylene copolymers may also be used. The melting point of the polymer used for such a membrane is preferably not more than 120° C. A preferred thickness is in the range 0.8 to 3 mil (0.02 to 0.07 mm).

In one preferred embodiment the wipes of the present invention comprise two water impermeable membranes, preferably polyethylene membranes, two cleaning substrates, preferably batting and two scrubbing substrates, preferably composed of polymeric scrim.

In another preferred embodiment the wipes comprise one water impermeable membrane, two batting substrates, one non woven hydroentangled cleaning substrate and one scrubbing substrate, preferably polymeric scrim. Particularly preferably the two batting layers are in contact and the dishwashing composition is sandwiched between one batting substrate and the polymeric membrane and the non-woven hydroentangled cleaning substrate is in contact with the opposite side (ie the side not in contact with the dishwashing composition) of the polymeric membrane to form an external layer. The external layer on the side presented by the batting layer not in contact with the dishwashing composition is formed by a polymeric scrim in contact with one of the batting layers.

The stiffness of the wipe when wet is an important preferred feature. Stiffness is expressed in Taber stiffness units, preferably measured in accordance with ASTM D-5650 (resistance to bending of paper of low bending stiffness). Stiffness of the wipe when dry is measured before it is used for cleaning a surface. Stiffness of the wipe when wet is measured after it has been saturated in water.

Preferably stiffness when dry is at least 5, preferably at least 6, more preferably at least 7 and in particular at least 8 Taber stiffness units. In particularly preferred cases stiffness when dry is at least 9 Taber stiffness units.

A particular advantage of preferred stiffness-enhancing aspects of the invention is that the Taber stiffness when wet is at least 5, preferably at least 6, more preferably at least 7 and in particular at least 8. In particularly preferred embodiments the stiffness when wet is at least 9 Taber stiffness units.

The particularly preferred embodiments have stiffness when wet at least 50%, preferably at least 60%, more preferably at least 80% and in particular at least 90% of stiffness when dry.

Optional Dishwashing Composition Components

Skin Therapeutic Agents

The present compositions may comprise a skin therapeutic agent. By skin therapeutic agent it is meant an agent which when added to the dishwashing agent has a beneficial affect on the skin of the user.

Examples of skin therapeutic agents are described in the Applicants copending U.S. patent application Ser. No. 09/443196 and are incorporated herein by reference.

Solvent

The present compositions may preferably comprise a solvent. Suitable solvents include diols polymeric glycols and mixtures of both diols and polymeric glycols. Diols suitable for use in the present invention have the following formula:

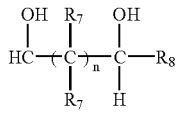

wherein n=0–3, $R_7$=H, methyl or ethyl; and $R_8$=H, methyl, ethyl, propyl, isopropyl, butyl and isoubutyl. Preferred diols include propylene glycol, 1,2 hexanediol, 2-ethyl-1,3-hexanediol and 2,2,4-trimethyl-1,3-pentanediol. When diols are present, the present compositions will comprise at least about 0.5%, more preferably at least about 1%, even more preferably still, at least about 3% by weight of the composition of diols. The composition will also preferably contain no more than about 20%, more preferably no more than about 10%, even more preferably, no more than about 6% by weight of the composition of diols.

Polymeric glycols, which comprise ethylene oxide (EO) and propylene oxide (PO) groups may also be included in the present invention. These materials are formed by adding blocks of ethylene oxide moieties to the ends of polypropylene glycol chains. Polymeric gycols suitable for use in the present invention are of the following formula:

$$(PO)_x(EO)_yH$$

wherein x+y is from about 17 to 68, and x/(x+y) is from about 0.25 to 1.0. A preferred polymeric glycol is a polyproylene glycol (corresponding to when y≈0) having an average molecular weight of between about 1000 to about 5000, more preferably between about 2000 to about 4000, most preferably about 2000 to about 3000.

When polymeric glycols are present the present liquid detergent compositions will contain at least about 0.25%, more preferably at least about 0.5%, even more preferably still, at least about 0.75% by weight of the composition of polymeric glycols. The composition will also preferably contain no more than about 5%, more preferably no more than about 3%, even more preferably, no more than about 2% by weight of the composition.

To insure satisfactory physical stability, whenever polymeric glycols are added to a liquid dishwashing composition, it may be necessary to also include either a diol and/or an alkali metal inorganic salt, such as sodium chloride. Suitable amounts of diols to provide physical stability are in the amounts in the ranges found above, while a suitable amount of an alkali metal inorganic salt is at least about 0.1% and less than about 1.5%, preferably less than about 0.8% by weight of the composition.

As discussed above, the addition of diols can improve the physical and enzymatic stability of a liquid dishwashing composition.

Other suitable solvents include lower alkanols, diols, other polyols, ethers, amines, and the like may be used in the present invention. Particularly preferred are the C1-C4 alkanols.

Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1-C5 alcohols, linear C1-C5 alcohols, C8-C14 alkyl and cycloalkyl hydrocarbons and halohydrocarbons, C6-C16 glycol ethers and mixtures thereof.

Besides propylene glycol,polypropylene glycol and the diols illustrated above, other glycols according to the formula: HO—CR1 R2—OH wherein R1 and R2 are independently H or a C2-C10saturated or unsaturated aliphatic hydrocarbon chain and/or cyclic are suitable and can be used herein. One such suitable glycol is dodecaneglycol.

Suitable alkoxylated glycols which can be used herein are according to the formula $$R\text{-}(A)_n\text{-}R^1\text{—}OH$$

wherein R is H, OH, a linear saturated or unsaturated alkyl of from 1 to 20 carbon atoms, preferably from 2 to 15 and more preferably from 2 to 10, wherein $R^1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R (A)n-OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable linear C1-C5 alcohols which can be used herein are according to the formula R—OH wherein R is a linear saturated or unsaturated alkyl group of from 1 to 5 carbon atoms, preferably from 2 to 4. Suitable linear $C_1$-$C_5$ alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents which can be used herein are butoxy propoxy propanol, butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL R solvents or water-soluble CELLOSOLVE R solvents; water-soluble CARBITOL R solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE R solvents are compounds of the 2-alkoxyethoxy ethanol class, with 2-butoxyethoxyethanol being preferred. Other suitable solvents include benzyl alcohol, and diols such as 2-ethyl-1, 3-hexanediol and 2,2,4-trimethyl-1,3-pentanediol and mixtures thereof. Some preferred solvents for use herein are n-butoxypropoxypropanol, BUTYL CARBITOL O and mixtures thereof.

The solvents can also be selected from the group of compounds comprising ether derivatives of mono-, di- and tri-ethylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred solvents including mono- and di-ethylene glycol n-hexyl ether are available from the Union Carbide company.

When present the composition will preferably contain at least about 0.01%, more preferably at least about 0.5%, even more preferably still, at least about 1% by weight of the composition of solvent. The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents are broadly defined as compounds that are liquid at temperatures of 20° C.-25° C. and which are not considered to be surfactants. One of the distinguishing features is that solvents tend to exist as discrete entities rather than as broad mixtures of compounds. Examples of suitable solvents for the present invention include ethanol, propanol, isopropanol, 2-methyl pyrrolidinone, benzyl alcohol and morpholine n-oxide. Preferred among these solvents are ethanol and isopropanol.

Thickening Agent

In a preferred embodiment of the present invention the dishwashing composition comprises a thickening agent. The thickening agent may be selected from any known thickening agency capable of thickening a composition to a solid, more preferably paste consistency. Suitable thickening agents may be selected from the group of agents discussed on pages 95-130 of Polymers and Thickeners (vol 108, May 1993, compiled and edited by Robert Y Lockhead and William R Fron, dept of polymer science of Uni of Southern Mississippi, published by Alourd Publishing Company). In a preferred embodiment the thickening agent is hydroxy propyl methyl cellulose (HPMC).

Amines

Another optional although preferred ingredient of the compositions according to the present invention is an amine, more preferably a monoamine, diamine, triamine, most preferably a diamine. In the context of a hand dishwashing composition, the "usage levels" of such diamine in the compositions herein can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least about 0.1%, more preferably at least about 0.2%, even more preferably, at least about 0.25%, even more preferably still, at least about 0.5% by weight of said composition of diamine. The composition will also preferably contain no more than about 15%, more preferably no more than about 10%, even more preferably, no more than about 6%, even more preferably, no more than about 5%, even more preferably still, no more than about 1.5% by weight of said composition of diamine.

Preferred monoamines of the compositions of the present invention include monoethanol amine (MEA) and triethanolamine (TEA).

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2

As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, New York and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, New York, 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

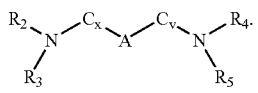

wherein $R_{2-5}$ are independently selected from H, methyl, —$CH_3CH_2$, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Examples of preferred diamines can be found in the copending provisional patent application of Phillip Kyle Vinson et al., entitled "Dishwashing Detergent Compositions Containing Organic Diamines for Improved Grease Cleaning, Sudsing, Low Temperature Stability and Dissolution", having P & G Case No. 7167P, application Ser. No. 60/087,693, and filed on Jun. 2, 1998, which is hereby incorporated by reference.

Preferred polyamines include polyalkylamines. The term polyamine used herein does not include alkoxylated polyalkylamines, such as ethoxylated and/or propoxylated polyalkylamine. These compounds are unsuitable for use in the compositions of the present invention because such substituient and structural modifications lower pKa below about 7.0 and cause losses in performance. Furthermore, while not wanting to be limited to theory, it is believed that alkoxylated polyalkylamines can interact with any anionic surfactant in a negative fashion as well as unwanted steric effects from the alkoxylated polyalkylamines.

Preferred polyamine polymers are the $C_2$-$C_3$ polyalkyleneamines and polyalkyleneimines. Particularly preferred polyalkyleneamines and polyalkyleneimines are the polyethyleneamines (PEAs) and polyethyleneimines (PELs). Preferred have a molecular weight of from about 140 to about 310, preferably from about 140 to about 200. These PEAs can be obtained by reactions involving ammonia and ethylene dichloride, followed by fractional distillation. The common PEAs obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372 to Dickson, issued May 14, 1957, which describes the preparation of PEAs.

Preferred PELs used herein have an average molecular weight of from about 600 to about 2600. Although linear polymer backbones are possible, branched chains can also occur. The relative proportions of primary, secondary and tertiary amine groups present in the polymer can vary, depending on the manner of preparation. These PELs can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PELs are disclosed in U.S. Pat. No. 2,182,306 to Ulrich et al., issued Dec. 5, 1939; U.S. Pat. No. 3,033,746 to Mayle et al., issued May 8, 1962; U.S. Pat. No. 2,208,095 to Esselmann et al., issued Jul. 16, 1940; U.S. Pat. No. 2,806,839 to Crowther, issued Sep. 17, 1957; and U.S. Pat. No. 2,553,696 to Wilson, issued May 21, 1951 (all incorporated herein by reference).

Generally, the polyamines can be included in an amount of from about 0.001% to about 5% by weight of the composition, with the preferred range being from about 0.005% to about 3% by weight, and a more preferred range of about 0.01% to 2%.

An example of suitable polyalkylamine has the general formula:

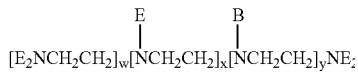

wherein B is a continuation by branching of the polyethyleneimine backbone and E is hydrogen, lower alkyl (that is $C_1$ to $C_6$ alkyl), or mixtures thereof.

The units which make up the polyalkyleneimine backbones are derived from primary amine units having the formula:

$$[H_2N—CH_2CH_2]— \text{ and } —NH_2$$

which terminate the main backbone and any branching chains, secondary amine units having the formula:

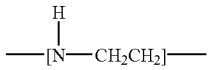

and tertiary amine units having the formula:

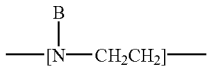

which are the branching points of the main and secondary backbone chains, B representing a continuation of the chain structure by branching. During the formation of the polyamine backbones cyclization may occur, therefore, an amount of cyclic polyamine can be present in the parent polyalkyleneimine backbone mixture.

Most preferred polyamines are selected from the group consisting of triethylenetetramine (TETA) tetraethylenepentamine (TEPA), hexaethylhexamine, heptaethylheptamines, octaethyloctamines, nonethyinonamines, and mixtures thereof, more preferably triethylenetetramine (TETA) tetraethylenepentamine (TEPA), and mixtures therof.

Surfactants

The compositions of the present invention may optionally although preferably comprise a surfactant selected from the group consisting of amphoteric, zwitterionic, nonionic, anionic, cationic surfactants and mixtures thereof.

Amphoteric surfactants are preferred additional surfatcants. The amphoteric surfactants useful in the present invention are preferably selected from amine oxide surfactants. Amine oxides are semi-polar nonionic surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

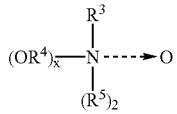

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{12}$ alkoxy ethyl dihydroxy ethyl amine oxides.

Also suitable are amine oxides such as propyl amine oxides, represented by the formula:

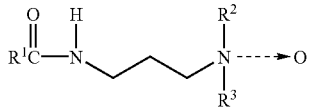

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10. Particularly preferred are amine oxides of the formula.

A further suitable species of amine oxide semi-polar surface active agents comprise compounds and mixtures of compounds having the formula:

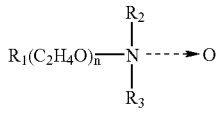

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10. Particularly preferred are amine oxides of the formula:

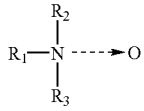

wherein $R_1$ is a $C_{10-14}$ alkyl and $R_2$ and $R_3$ are methyl or ethyl. Because they are low-foaming it may also be desirable to use long chain amine oxide surfactants which are more fully described in U.S. Pat. No. 4,316,824 (Pancheri), U.S. Pat. Nos. 5,075,501 and 5,071,594, incorporated herein by reference.

Other suitable, non-limiting examples of amphoteric detergent surfactants that are useful in the present invention include amido propyl betaines and derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Further examples of suitable amphoteric surfactants are given in "Surface Active Agents and Detergents" (Vol. I and II by Schwartz, Perry and Berch), hereby incorporated by reference.

Preferably the amphoteric surfactant where present, is present in the composition in an effective amount, more preferably from about 0.1% to about 20%, even more preferably about 0.1% to about 15%, even more preferably still from about 0.5% to about 1 0%,by weight.

Suitable nonionic detergent surfactants are generally disclosed in U.S. Pat. No. 3,929,678, Laughlin et al., issued Dec. 30, 1975, at column 13, line 14 through column 16, line 6, incorporated herein by reference.

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$-$C_{15}$ linear secondary alcohol with 9 moles ethylene oxide), Tergitol® 24-L-6 NMW (the condensation product of $C_{12}$-$C_{14}$ primary alcohol with 6 moles ethylene oxide with a narrow molecular weight distribution), both marketed by Union Carbide Corporation; Neodol® 45-9 (the condensation product of $C_{14}$-$C_{15}$ linear alcohol with 9 moles of ethylene oxide), Neodol® 23-6.5 (the condensation product of $C_{12}$-$C_{13}$ linear alcohol with 6.5 moles of ethylene oxide), Neodol® 45-7 (the condensation product of $C_{14}$-$C_{15}$ linear alcohol with 7 moles of ethylene oxide), Neodol® 45-4 (the condensation product of $C_{14}$-$C_{15}$ linear alcohol with 4 moles of ethylene oxide), marketed by Shell Chemical Company, and Kyro® EOB (the condensation product of $C_{13}$-$C_{15}$ alcohol with 9 moles ethylene oxide), marketed by The Procter & Gamble Company. Other commercially available nonionic surfactants include Dobanol 91-8(® marketed by Shell Chemical Co. and Genapol UD-080® marketed by Hoechst. This category of nonionic surfactant is referred to generally as "alkyl ethoxylates."

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

$$R^6\overset{\overset{\displaystyle O}{\|}}{C}N(R^7)_2$$

wherein $R^6$ is an alkyl group containing from about 7 to about 21 (preferably from about 9 to about 17) carbon atoms and each $R^7$ is selected from the group consisting of hydrogen, $C_1$-$C_4$ alkyl, $C_1$-$C_4$ hydroxyalkyl, and —$(C^2H4O)_xH$ where x varies from about 1 to about 3.

Preferred amides are $C_8$-$C_{20}$ ammonia amides, monoethanolamides, diethanolamides, and isopropanolamides.

Preferably the nonionic surfactant, when present in the composition, is present in an effective amount, more preferably from about 0.1% to about 20%, even more preferably about 0.1% to about 15%, even more preferably still from about 0.5% to about 10%,by weight.

The detergent compositions hereof may also contain an effective amount of polyhydroxy fatty acid amide surfactant. By "effective amount" is meant that the formulator of the composition can select an amount of polyhydroxy fatty acid amide to be incorporated into the compositions that will improve the cleaning performance of the detergent composition. In general, for conventional levels, the incorporation of about 1%, by weight, polyhydroxy fatty acid amide will enhance cleaning performance.

Where present, the detergent compositions may comprise about 1% weight basis, polyhydroxy fatty acid amide surfactant, preferably from about 3% to about 30%, of the polyhydroxy fatty acid amide. The polyhydroxy fatty acid amide surfactant component comprises compounds of the structural formula:

$$R^2\overset{\overset{\displaystyle O}{\|}}{C}N\underset{\underset{\displaystyle R^1}{|}}{Z}$$

wherein: $R^1$ is H, $C_1$-$C_4$ hydrocarbyl, 2-hydroxy ethyl, 2-hydroxy propyl, or a mixture thereof, preferably $C_1$-$C_4$ alkyl, more preferably $C_1$ or $C_2$ alkyl, most preferably $C_1$ alkyl (i.e., methyl); and $R^2$ is a $C_5$-$C_{31}$ hydrocarbyl, preferably straight chain $C_7$-$C_{19}$ alkyl or alkenyl, more preferably straight chain $C_9$-$C_{17}$ alkyl or alkenyl, most preferably straight chain $C_{11}$-$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, and alkoxylated derivatives thereof, where n is an integer from 3 to 5, inclusive, and R' is H or a cyclic or aliphatic monosaccharide. Most preferred are glycityls wherein n is 4, particularly —$CH_2$—$(CHOH)_4$—$CH_2OH$.

R' can be, for example, N-methyl, N-ethyl, N-propyl, N-isopropyl, N-butyl, N-2-hydroxy ethyl, or N-2-hydroxy propyl.

$R^2$-CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Anionic surfactants include salts (including, for example, sodium, potassium, ammonium, and substituted ammonium salts such as mono-, di- and triethanolamine salts) of soap, $C_8$-$C_{24}$ olefinsulfonates, sulfonated polycarboxylic acids prepared by sulfonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO$—$M^+$wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Suitable anionic surfactants for use in the compositions herein include water-soluble salts or acids of the formula $ROSO_3M$ wherein R preferably is a $C_6$-$C_{20}$ linear or branched hydrocarbyl, preferably an alkyl or hydroxyalkyl having a C10-$C_{20}$ alkyl component, more preferably a $C_{10}$-$C_{14}$ alkyl or hydroxyalkyl, and M is H or a cation, e.g., an alkali metal cation or ammonium or substituted ammonium, but preferably sodium.

Other suitable anionic surfactants for use herein are water-soluble salts or acids of the formula $RO(A)_mSO_3M$ wherein R is an unsubstituted linear or branched $C_6$-$C_{20}$ alkyl or hydroxyalkyl group having a $C_{10}$-$C_{20}$ alkyl component, preferably a $C_{12}$-$C_{20}$ alkyl or hydroxyalkyl, more preferably $C_{12}$-$C_{14}$ alkyl or hydroxyalkyl, A is an ethoxy or propoxy unit, m is greater than zero, typically between about 0.5 and 5, more preferably between 0.5 and 2, and M is H or a cation which can be, for example, a metal cation, ammonium or substituted-ammonium cation. Alkyl ethoxylated sulfates as well as alkyl propoxylated sulfates are contemplated herein. Exemplary surfactants are $C_{10}$-$C_{14}$ alkyl polyethoxylate (1.0) sulfate, $C_{10}$-$C_{14}$ polyethoxylate (1.0) sulfate, $C_{10}$-$C_{14}$ alkyl polyethoxylate (2.25) sulfate, $C_{10}$-$C_{14}$ polyethoxylate (2.25) sulfate, $C_{10}$-$C_{14}$ alkyl polyethoxylate (3.0) sulfate, $C_{10}$-$C_{14}$ polyethoxylate (3.0) sulfate, and $C_{10}$-$C_{14}$ alkyl polyethoxylate (4.0) sulfate, $C_{10}$-$C_{18}$ polyethoxylate (4.0) sulfate. In a preferred embodiment the anionic surfactant is a mixture of alkoxylated, preferably ethoxylated and non-alkoxylated sulfate surfactants. In such a preferred embodiment the preferred average degree of alkoxylation is from 0.4to 0.8.

Other particularly suitable anionic surfactants for use herein are alkyl sulphonates including water-soluble salts or acids of the formula $RSO_3M$ wherein R is a $C_6$-$C_{20}$ linear or branched, saturated or unsaturated alkyl group, preferably a $C_{10}$-$C_{20}$ alkyl group and more preferably a $C_{10}$-$C_{14}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_{12}$-$C_{16}$ alkyl group and more preferably a $C_{10}$-$C_{14}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

In a further preferred embodiment the carbon chain of the anionic surfactant comprises alkyl, preferably C1-4 alkyl branching units. The average percentage branching of the anionic surfactant is greater than 30%, more preferably from 35% to 80% and most preferably from 40% to 60%. Such average percentage of branching can be achieved by formulating the composition with one or more anionic surfactants all of which are preferably greater than 30% branched, more preferably from 35% to 80% and most preferably from 40% to 60%. Alternatively and more preferably, the composition may comprise a combination of branched anionic surfactant and linear anionic surfactant such that on average the percentage of branching of the total anionic surfactant combination is greater than 30%, more preferably from 35% to 80% and most preferably from 40% to 60%.

Other particularly suitable anionic surfactants for use herein are alkyl carboxylates and alkyl alkoxycarboxylates having from 4 to 24 carbon atoms in the alkyl chain, preferably from 8 to 18 and more preferably from 8 to 16, wherein the alkoxy is propoxy and/or ethoxy and preferably is ethoxy at an alkoxylation degree of from 0.5 to 20, preferably from 5 to 15. Preferred alkylalkoxycarboxylate for use herein is sodium laureth 11 carboxylate (i.e., $RO(C_2H_4O)_{10}$—$CH_2COON$, with R=C12-C14) commercially available under the name Akyposoft® 100NV from Kao Chemical Gbmh.

The particular surfactants used can therefore vary widely depending upon the particular end-use envisioned. Suitable additional surfactants are described in detail in the copending provisional patent application of Chandrika Kasturi et al., entitled "Liquid Detergent Compositions Comprising Polymeric Suds Enhancers", having P & G Case No. 6938P, application Ser. No. 60/066,344, incorporated above.

Polymeric Suds Stabilizer

The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

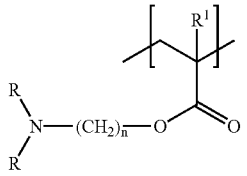

wherein each R is independently hydrogen, $C_1$-$C_8$ alkyl, and mixtures thereof, $R^1$ is hydrogen, $C_1$-$C_6$ alkyl, and mixtures thereof, n is from 2 to about 6; and ii) copolymers of (i) and

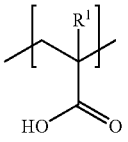

wherein $R^1$ is hydrogen, C1-C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

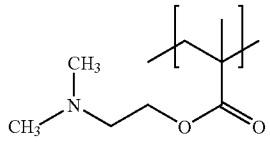

When present in the compositions, the polymeric suds booster may be present in the composition from about 0.01% to about 15%, preferably from about 0.05% to about 10%, more preferably from about 0.1% to about 5%, by weight.

Carboxylic Acid

The compositions according to the present invention may comprise a linear or cyclic carboxylic acid or salt thereof. In a preferred embodiment the composition comprises an acid or salt thereof which is linear and comprises from 1 to 6 carbon atoms or a cyclic acid which comprises greater than 3 carbon atoms. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms and mixtures thereof The carboxylic acids or salts thereof preferably have a pKa1 of less than 7, more preferably from 1 to 3. The carboxylic acid and salts thereof may comprise one or two or more carboxylic groups.

Suitable carboxylic acids or salts thereof are those having the general formula:

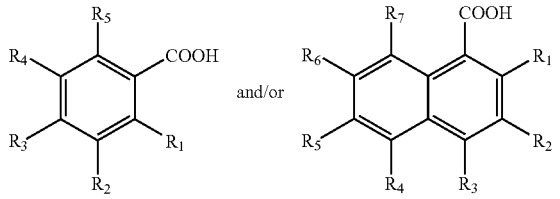

wherein $R_1$, $R_2$, $R_3$, $R_4$, $R_5$, $R_6$, $R_7$ are selected from the group consisting of alkyl chain having from 1 to 3 carbon atoms, hydroxy group, hydrogen, ester group, carboxylic acid group with the proviso that no more than 3 carboxylic acid groups are present.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2, 4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof is preferably present at the level of from 0.1% to 5%, more preferably from 0.2% to 1% and most preferably from 0.25% to 0.5%.

The presence of such preferred acids or salts thereof have been found to provide improved rinse feel as described in the Applicants co-pending European Applications number Builder The compositions according to the present invention may further comprise a builder system. Because builders such as citric acid and citrates impair the stability of enzymes in LDL compositions, it is desirable to include reduce the amounts or completely remove the builder salts normally utilized in LDL compositions incorporating propylene glycol as a builder. When a detergent composition includes propylene glycol solvent as a part or a whole of the detergent's carrier, enzymes are more stable and smaller amounts or no builder salts are needed.

If it is desirable to use a builder, then any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) $CH_2$(COOH) wherein R is $C_{10-20}$ alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

If detergency builder salts are included, they will be included in amounts of from 0.5% to 50% by weight of the composition preferably from 5% to 30% and most usually from 5% to 25% by weight.

Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition. Preferred proteolytic enzymes, then, are selected from the group consisting of Alcalase® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Further non-limiting examples of suitable and preferred enzymes are disclosed in the copending application: "Dishwashing Detergent Compositions Containing Organic Diamines for Improved Grease Cleaning, Sudsing, Low temperature stability and Dissolution", having P & G Case No. 7167P and application Ser. No. 60/087,693, which is hereby incorporated by reference.

Because hydrogen peroxide and builders such as citric acid and citrates impair the stability of enzymes in LDL compositions, it is desirable to reduce or eliminate the levels of these compounds in compositions which contain enzymes. Hydrogen peroxide is often found as an impurity in surfactants and surfactant pastes. As such, the preferred level of hydrogen peroxide in the amine oxide or surfactant paste of amine oxide is 0-40 ppm, more preferably 0-15 ppm. Amine impurities in amine oxide and betaines, if present, should be minimized to the levels referred above for hydrogen peroxide.

Magnesium Ions

While it is preferred that divalent ions be omitted from LDL compositions prepared according to the present invention, alternate embodiments of the present invention may include magnesium ions.

It is desirable to exclude all divalent ions from the present LDL compositions, because such ions may lead to slower dissolution as well as poor rinsing, and poor low temperature stability properties. Moreover, formulating such divalent ion-containing compositions in alkaline pH matrices may be difficult due to the incompatibility of the divalent ions, particularly magnesium, with hydroxide ions.

Nonetheless, the presence of magnesium ions offers several benefits. Notably, the inclusion of such divalent ions improves the cleaning of greasy soils for various LDL compositions, in particular compositions containing alkyl ethoxy carboxylates and/or polyhydroxy fatty acid amide. This is especially true when the compositions are used in softened water that contains few divalent ions.

But in the present invention, these benefits can be obtained without the inclusion of divalent ions. In particular, improved grease cleaning can be achieved without divalent ions by the inclusion of organic diamines in combination with amphoteric and anionic surfactants in the specific ratios discussed above while enzymes have been shown to improve the skin mildness performance of the present LDL compositions.

If they are to be included in an alternate embodiment of the present LDL compositions, then the magnesium ions are present at an active level of from about 0.01% to 1.5%, preferably from about 0.015% to 1%, more preferably from about 0.025% to 0.5%, by weight. The amount of magnesium ions present in compositions of the invention will be also dependent upon the amount of total surfactant present therein, including the amount of alkyl ethoxy carboxylates and polyhydroxy fatty acid amide.

Preferably, the magnesium ions are added as a hydroxide, chloride, acetate, sulfate, formate, oxide or nitrate salt to the compositions of the present invention. Because during storage, the stability of these compositions becomes poor due to the formation of hydroxide precipitates in the presence of compositions containing moderate concentrations of hydroxide ions, it may be necessary to add certain chelating agents. Suitable chelating agents are discussed further below and in U.S. Pat. No. 5,739,092, issued Apr. 14, 1998, to Ofosu-asante, incorporated herein by reference.

Skin Treatment Agent

In a preferred aspect of the present invention, the composition comprises a skin treatment agent. By skin treatment agent it is meant a component that Perfumes Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein can be found in the copending provisional patent application: "Dishwashing Detergent Compositions Containing Organic Diamines for Improved Grease Cleaning, Sudsing, Low temperature stability and Dissolution", having P & G Case No. 7167P, application Ser. No. 60/087,693, incorporated above.

In a preferred aspect of the present invention, the composition comprises a blooming perfume. A blooming perfume ingredient is characterized by its boiling point (B.P.) and its octanol/water partition coefficient (P). The octanol/water partition coefficient of a perfume ingredient is the ratio between its equilibrium concentrations in octanol and in water. The preferred perfume ingredients of this invention have a B.P., determined at the normal, standard pressure of about 760 mm Hg, of about 260° C. or lower, preferably less than about 255° C.; and more preferably less than about 250° C., and an octanol/water partition coefficient P of about 1,000 or higher. Since the partition coefficients of the preferred perfume ingredients of this invention have high values, they are more conveniently given in the form of their logarithm to the base 10, logP. Thus the preferred perfume ingredients have logP of about 3 or higher, preferably more than about 3.1, and even more preferably more than about 3.2.

More preferably the composition may comprise a combination of blooming perfume ingredients. A Particularly preferred blooming perfume composition comprises a first perfume ingredient having boiling point of 250° C. or less and ClogP of 3.0 or less; and a second perfume ingredient having boiling point of 250° C. or less and Clog P of 3.0 or more. More preferably the composition comprises at least 5%, even more preferably at least 7.5% by weight of said first ingredient and at least 30%, even more preferably at least 35% by weight of said second ingredient.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetrace-tates, N-hydroxyethylethylenediaminetriacetates, nitrilo-tri-acetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.00015% to about 15% by weight of the detergent compositions herein. More preferably, if utilized, the chelating agents will comprise from about 0.0003% to about 3.0% by weight of such compositions.

pH and Buffering Agents

The composition preferably has a pH as measured in a 10% solution thereof, of above 6. More preferably the composition has a pH of greater and 7, most preferably between 8 and 10. In order to maintain the pH at the optimum level it may be preferably to include a buffering agent capable of providing a generally more alkaline pH in the composition and in dilute solutions. Dishwashing compositions as used herein may therefore contain from 0.1% to 15%, preferably from 1% to 10%, most preferably from 2% to 8%, by weight, of a buffering agent. The pKa value of this buffering agent should be about 0.5 to 1.0 pH units below the desired pH value of the composition (determined as described above Preferably, the pKa of the buffering agent should be greater than 5.

Preferred inorganic buffers/alkalinity sources include the alkali metal carbonates, alkali metal hydroxides and alkali metal phosphates, e.g., sodium carbonate, sodium hydroxide, sodium polyphosphate.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. The diamines, described in detail above, also act as buffering agents and are preferred buffering agents. Preferred buffering system for use in the present detergent compositions include a combination of 0.5% diamine and 2.5% citrate and a combination of 0.5% diamine, 0.75% potassium carbonate and 1.75% sodium carbonate. Other preferred nitrogen-containing buffering agents are Tri(hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Mixtures of any of the above are also acceptable. For additional buffers see McCutcheon's EMULSIFIERS AND DETERGENTS, North American Edition, 1997, McCutcheon Division, MC Publishing Company Kirk and WO 95/07971 both of which are incorporated herein by reference.

Other Inqredients

The detergent compositions will further preferably comprise one or more detersive adjuncts selected from the following: soil release polymers, polymeric dispersants, polysaccharides, abrasives, bactericides and other antimicrobials, tarnish inhibitors, builders, enzymes, dyes, buffers, antifungal or mildew control agents, insect repellents, perfumes, hydrotropes, thickeners, processing aids, suds boosters, brighteners, anti-corrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%-5% of $C_{13-15}$ ethoxylated alcohol (EO 7) nonionic surfactant. Typically, the enzyme/surfactant solution is 2.5× the weight of silica. The resulting-powder is dispersed with stirring in silicone oil (various silicone oil viscosities in the range of 500-12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Further, these hand dishwashing detergent embodiments preferably further comprises a hydrotrope. Suitable hydrotropes include sodium, potassium, ammonium or water-soluble substituted ammonium salts of toluene sulfonic acid, naphthalene sulfonic acid, cumene sulfonic acid, xylene sulfonic acid.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

EXAMPLES

The following examples are illustrative of the present invention, but are in no way meant to be limiting. All parts, percentages and ratios used herein are expressed as percent weight unless otherwise specified.

Composition I-VIII are prepared comprising the following ingredients.

| | I | II | III | IV | V | VI | VII | VIII |
|---|---|---|---|---|---|---|---|---|
| Na C12-14E0.6S ave degree of branching 0-20% | 48.5 | — | — | — | 48.5 | 0 | 0 | 63 |
| Na C12-14E0.6S ave degree of branching 40-50% | | 45.5 | 36 | | | 0 | 0 | |
| NaC12-14E1.4S ave degree of branching 40-50% | | — | — | | | 33 | 45 | |
| C12-14 Linear alkyl/aryl sulphonate | — | 3 | — | 5 | — | 10 | — | — |
| Na C12-14E3S | — | — | — | 43.5 | — | — | 0 | |
| Amine oxide $C_{12-14}$ | 11.9 | 11.9 | 11.9 | 11.9 | 11.9 | 3.6 | 4.9 | 15.5 |
| C1214 glucose amide | 0 | 0 | 0 | 0 | 0 | 5.4 | 0 | |
| Alkyl dimethyl betaine | 0 | 0 | 0 | 0 | 0 | 3.6 | 0 | |
| $C_{10}E_8$ | 5.4 | 5.4 | 9 | 5.4 | 5.4 | 7.2 | 0 | 7 |
| 1,3 cyclohexane bis (methylamine) | 0.9 | 0.9 | 0 | 0.9 | 0.9 | 0 | 0 | 1.2 |
| Homopolymer of dimethyl aminoethyl methacrylate | 0.36 | 0.36 | 0 | 0.36 | 0.36 | 0 | 0 | 0.5 |
| Salicylic acid | 0.9 | — | 0 | 0.9 | — | 0 | 0.45 | 0 |
| Maleic acid | — | — | 0 | — | 0.9 | 0.9 | 0.45 | |
| NaOH | balance to pH 8 | balance to pH 8 | balance to pH 7 | balance to pH 6 | balance to pH 7 | balance to pH 9 | balance to pH 10 | balance to pH 6 |
| Mg++ | 0 | 0 | 0.9 | 0 | 0 | 0.9 | 0.036 | |

-continued

| | I | II | III | IV | V | VI | VII | VIII |
|---|---|---|---|---|---|---|---|---|
| Cl2 fatty acid | 0 | 0 | 0 | 0 | 0 | 0 | 3.6 | |
| hydroxy propyl methyl cellulose polymer | 10 | 10 | 10 | 10 | 10 | 10 | 10 | 2 |
| Perfume | 2 | 2 | 2 | 2 | 2 | 2 | 2 | 2 |
| Dye | 0.375 | 0 | 0.375 | 0.375 | 0 | 0.375 | 0.375 | 0.375 |
| Water | balance | balance | balance | balance | balance | balance | balance | balance |

The dishwashing composition is applied to one side of a first cleaning substrate by brushing onto one side of the substrate 4.4 grams of dishwashing composition to a 70 mm by 65 mm area. The cleaning substrate is a lofty, low density batting comprising a blend of polyester fibers, and bicomponent fibers with a polyester core and a polyethylene sheath. A second cleaning substrate of the same type is laminated to the treated side of the first substrate. Two scrubbing substrates composed of a nylon scrim web are laminated to the non-dishwashing composition treated side of the second cleaning substrate. All substrates are heat sealed around the periphery of the wipe.

In another embodiment, 6 g of cleaning composition (formula VII) is sandwiched between 2 pre-perforated polyethylene membranes comprising approximately 30, 1-mm diameter perforations evenly distributed across the surface, each membrane being 65 microns thick. The membranes are in turn sandwiched between 2 cleaning substrates of the same batting as described above. In order to avoid the polyethylene membranes gliding over one another, the membranes and cleaning substrates are dot heat sealed at even intervals across the surface of the cleaning substrates. Two scrubbing substrates composed of nylon scrim web are laminated to the one of the cleaning substrates. All substrates are heat sealed around the periphery of the wipe. In another embodiment the cleaning composition is sandwiched between a pre-perforated low density polyethylene (LDPE) membrane and a batting layer formed from carded, air laid non woven material made up of a blend of polyester fibres and bicomponent fibres having a polyester core and a polyethylene sheath. A second layer of the same type is laminated onto this batting layer. Onto the other side of the LDPE is laminated a nonwoven hydroentangled topsheet formed from a blend of polypropylene and viscose fibres. The second batting layer is laminated to a scrim of polypropylene fibres. All layers are bonded by means of intermittent ultrasonic bonding.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation and the scope. It will be clear to those skilled in the art that various changes and modifications may be made without departing from the scope of the invention and the invention is not to be considered limited to the embodiments and examples that are described in the specification is defined by the appended claims which should be construed as broadly as the prior art will permit.

What is claimed is:

1. A dishwashing wipe consisting of (a) a nonwoven hydroentangled polymer fiber topsheet; (b) a polymeric membrane; (c) nowoven batting layers; (d) a polymeric scrim; and (e) a dishwashing composition, wherein (a), (b) and (c) are cleaning substrates and (d) is a scrubbing substrate; wherein said dishwashing composition comprises one or more of an amine, polymeric suds stabilizer and enzymes, and said composition is in the form of stripes that are positioned between said cleaning substrate and said scrubbing substrate and wherein said cleaning substrate is softer than said scrubbing substrate.

2. A dishwashing wipe according to claim 1 wherein the polymeric scrim is made of one or more of the following fibers: polyamide, polyethylene, and polypropylene fibers.

3. A dishwashing wipe according to claim 1 wherein the dishwashing composition is substantially dry.

4. A dishwashing wipe according to claim 1 wherein said dishwashing composition further comprises components selected from the group consisting of: surfactant, salts, solvent, skin treatment agents, perfumes and mixtures thereof.

5. A dishwashing wipe according to claim 1 wherein said amine is selected from the group consisting of: monoamine, diamine, and triamine.

6. A dishwasbing wipe according to claim 1 wherein the disbwashing composition is in the form of a paste.

7. A dishwashing wipe according to claim 1 wherein the polymeric membrane is attached to the rest of the cleaning substrates by heat sealing in the form of discrete heat seals that are distributed across a surface of the cleaning substrate.

8. A dishwashing wipe according to claim 1 having a Taber stiffness when wet at least 50% of its Taber stiffness when dry.

* * * * *